US008297804B2

(12) United States Patent
Buse

(10) Patent No.: US 8,297,804 B2
(45) Date of Patent: Oct. 30, 2012

(54) RECESSED LIGHT FIXTURE HAVING INTEGRALLY FORMED MOUNTING TRACKS

(75) Inventor: Jeffrey Buse, Mooreville, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 356 days.

(21) Appl. No.: 12/503,879

(22) Filed: Jul. 16, 2009

(65) Prior Publication Data

US 2011/0013405 A1 Jan. 20, 2011

(51) Int. Cl.
*F21S 8/00* (2006.01)
*F21V 15/00* (2006.01)
*F21V 19/02* (2006.01)

(52) U.S. Cl. ..... 362/364; 362/147; 362/372

(58) Field of Classification Search ..... 362/364, 362/372, 147, 148, 285, 288, 365, 418, 419, 362/429, 430

See application file for complete search history.

(56) References Cited

U.S. PATENT DOCUMENTS

| | | | |
|---|---|---|---|
| 394,680 | A | 10/1888 | Dawes |
| 393,126 | A | 11/1888 | Smart |
| 684,264 | A | 10/1901 | Kemmerer |
| 866,473 | A | 9/1907 | Keefe et al. |
| 1,127,527 | A | 2/1915 | Schoen |
| 1,137,906 | A | 5/1915 | Rosenberg |
| 1,250,580 | A | 12/1917 | Harter |
| 1,501,524 | A | 7/1924 | Cousins |
| 1,631,488 | A | 6/1927 | Jones |
| 1,662,568 | A | 3/1928 | Foell |
| 1,704,626 | A | 3/1929 | Nero |
| 2,518,936 | A | 8/1950 | Roberts |
| 2,554,258 | A | 5/1951 | Lundquist |
| 2,647,202 | A | 7/1953 | Elmer |
| 2,716,185 | A | 8/1955 | Burliuk et al. |
| 2,739,226 | A | 3/1956 | Rex |
| 2,753,445 | A | 7/1956 | Thomas et al. |
| 2,757,818 | A | 8/1956 | Chanberlain |
| 2,762,598 | A | 9/1956 | Runge |
| 2,802,933 | A | 8/1957 | Broadwin |
| 2,842,281 | A | 7/1958 | Chisholm |
| 2,922,030 | A | 1/1960 | Bobrick |
| 2,937,841 | A | 5/1960 | Bodian |
| 2,965,348 | A | 12/1960 | Gerstel et al. |
| 3,057,993 | A | 10/1962 | Gellert |
| 3,082,023 | A | 3/1963 | Rudolph et al. |
| 3,099,404 | A | 7/1963 | Kaufman et al. |
| 3,168,252 | A | 2/1965 | Cagernoch |
| 3,182,187 | A | 5/1965 | Gellert |
| 3,286,090 | A | 11/1966 | Brown |
| 3,313,931 | A | 4/1967 | Klugman |
| 3,381,123 | A | 4/1968 | Docimo |
| 3,420,995 | A | 1/1969 | Dunckel |
| 3,512,743 | A | 5/1970 | Lipscomb |
| 3,518,420 | A | 6/1970 | Kripp |
| 3,609,346 | A | 9/1971 | Lund et al. |
| 3,683,173 | A | 8/1972 | Guth, Jr. |
| 3,697,742 | A | 10/1972 | Bobrick |
| 3,700,885 | A | 10/1972 | Bobrick |

(Continued)

*Primary Examiner* — David Crowe

(57) ABSTRACT

A recessed light fixture is provided with vertically extending mounting tracks integrally formed in opposed sidewalls of a light fixture housing. The mounting tracks have a continuous front face. The recessed light fixture also has a lamp support bar that extends between the mounting tracks and has at least one spring clip proximal each end thereof. Each at least one spring clip frictionally engages the front face of a corresponding of the mounting tracks, thereby allowing the lamp support bar to be temporarily affixed at a desired vertical orientation along the mounting tracks.

21 Claims, 6 Drawing Sheets

U.S. PATENT DOCUMENTS 3,749,873 A 7/1973 Harper et al.
3,778,609 A 12/1973 Liberman
3,872,296 A 3/1975 Cohen et al.
4,039,822 A 8/1977 Chan et al.
4,086,480 A 4/1978 Lahm
4,142,227 A 2/1979 Aikens
4,232,361 A 11/1980 Kelsall
4,250,540 A 2/1981 Kristofek
4,274,615 A 6/1981 Chan et al.
4,293,895 A 10/1981 Kristofek
4,336,575 A 6/1982 Gilman
4,408,262 A 10/1983 Kusmer
4,414,617 A 11/1983 Galindo
4,431,151 A 2/1984 Schonasky
4,459,648 A 7/1984 Ullman
4,471,416 A 9/1984 Druffel
4,473,873 A 9/1984 Quiogue
4,475,147 A 10/1984 Kristofek
4,510,559 A 4/1985 Kristofek
4,605,816 A 8/1986 Jorgensen et al.
4,623,956 A 11/1986 Conti
4,638,970 A * 1/1987 Phelan ..... 248/342
4,646,212 A 2/1987 Florence
4,729,080 A 3/1988 Fremont et al.
4,733,339 A 3/1988 Kelsall
4,745,533 A 5/1988 Smerz
4,751,624 A 6/1988 Russo et al.
4,751,627 A 6/1988 Usher
4,754,377 A 6/1988 Wenman
4,829,410 A 5/1989 Patel
4,881,157 A 11/1989 Pahl
4,887,196 A 12/1989 Brown et al.
5,045,985 A 9/1991 Russo et al.
5,068,772 A 11/1991 Shapiro et al.
5,122,944 A 6/1992 Webb
5,124,901 A 6/1992 Sojka et al.
5,130,914 A 7/1992 Bengochea
5,136,489 A * 8/1992 Cheng et al. ..... 362/294
5,140,507 A 8/1992 Harwood
5,154,507 A 10/1992 Collins
5,222,800 A 6/1993 Chan et al.
5,291,381 A 3/1994 Price
5,314,148 A 5/1994 Jones
5,317,493 A 5/1994 Muller et al.
5,325,281 A 6/1994 Harwood
5,373,431 A 12/1994 Hayman et al.
5,377,088 A 12/1994 Lecluze
5,452,193 A 9/1995 Hinnefeld et al.
5,457,617 A 10/1995 Chan et al.
5,538,214 A 7/1996 Sinila
5,556,188 A 9/1996 Poppenheimer
5,562,343 A 10/1996 Chan et al.
5,564,815 A 10/1996 Litman et al.
5,567,041 A 10/1996 Slocum
5,609,414 A 3/1997 Caluori
5,630,663 A 5/1997 Ling et al.
5,669,324 A 9/1997 Muir, III
5,672,004 A 9/1997 Schmidt, Jr.
5,738,436 A 4/1998 Cummings et al.
5,823,664 A 10/1998 Demshki, Jr. et al.
5,826,970 A 10/1998 Keller et al.
5,857,766 A 1/1999 Sieczkowski
5,868,493 A 2/1999 Winkelhake
5,941,625 A 8/1999 Morand
5,951,151 A 9/1999 Doubeck et al.
6,079,852 A 6/2000 Kamaya et al.
6,113,245 A 9/2000 Reinert, Sr.
6,132,245 A 10/2000 Wetz et al.
6,142,439 A 11/2000 Aramaki
6,145,798 A 11/2000 Janisse et al.
6,220,728 B1 4/2001 Andrus et al.
6,234,644 B1 5/2001 Kotovsky et al.
6,270,238 B1 8/2001 Mendelsohn et al.
6,343,873 B1 2/2002 Eberhard et al.
6,375,338 B1 4/2002 Cummings et al.
6,431,723 B1 8/2002 Schubert et al.
6,505,960 B2 1/2003 Schubert et al.
7,118,254 B2 10/2006 Czech
7,234,674 B2 6/2007 Rippel et al.
7,246,926 B2 7/2007 Harwood
7,306,359 B2 * 12/2007 Harwood ..... 362/648
7,357,541 B2 4/2008 Gamache et al.
7,434,967 B2 10/2008 Dupre
7,484,866 B1 2/2009 Buse
7,625,105 B1 * 12/2009 Johnson ..... 362/364

* cited by examiner

RECESSED LIGHT FIXTURE HAVING INTEGRALLY FORMED MOUNTING TRACKS

CROSS-REFERENCE TO RELATED DOCUMENTS

Not Applicable.

BACKGROUND

1. Field of the Invention

This invention pertains generally to a recessed light fixture, and more particularly to a recessed light fixture having integrally formed mounting tracks.

2. Description of the Related Art

Recessed fixtures may be installed in a ceiling or other structure such that a portion of the recessed fixture housing is hidden from a user's view. Many recessed fixtures have vertical adjustment mechanisms that allow for vertical adjustment of a lamp socket, lamp rail, or the like to enable an installed lamp to be placed at any one of a number of preselected locations. Vertical adjustment of the lamp may be desired for various reasons such as, for example, allowing multiple bulbs to be used with a recessed fixture, allowing a single bulb to be variably positioned, allowing multiple light Some recessed fixtures have vertical adjustment mechanisms that include a lamp support bar that supports a lamp socket and has a screw on each end thereof. The screws of the lamp support bar may be adjusted about vertical apertures within the recessed fixture housing and a nut tightened to the screws to fix the lamp support bar at a given height. Some recessed fixtures have a lamp support bar that supports a lamp socket and has one or more protrusions on each end thereof. The one or more protrusions may be inserted in corresponding ladder rung apertures of a track that is attached to the recessed fixture housing.

Many existing lamp height adjustment mechanisms utilize additional pieces such as, for example, screws, nits, and/or ladder rung tracks that must be separately affixed to the housing. Many existing lamp height adjustment mechanisms may not remain securely attached to the recessed fixture housing throughout the life of the recessed fixture housing. Moreover, many existing lamp height adjustment mechanisms include apertures or protuberances that may prove difficult or costly to manufacture and may also be overcomplicated in operation.

SUMMARY OF THE INVENTION

In some embodiments a recessed fixture is provided with a housing having housing sidewalls, a top, and a pan having a pan opening therethrough. The housing sidewalls, top, and pan surround and define a housing interior space. A pair of vertically extending mounting tracks are integrally formed in opposed of the housing sidewalls of the housing and extend into the housing interior space. Each of the mounting tracks have a continuous front face interiorly offset from the remainder of a corresponding of the housing sidewalls. A linearly extending lamp support bar has at least one spring clip proximal each end thereof. The lamp support bar extends horizontally within the housing between the mounting tracks and is vertically adjustable along the mounting tracks. Each spring clip of the lamp support bar frictionally engages the continuous relatively smooth uninterrupted front face of a corresponding of the mounting tracks, thereby allowing the lamp support bar to be temporarily affixed at a desired vertical orientation along the mounting tracks.

BRIEF DESCRIPTION OF THE ILLUSTRATIONS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
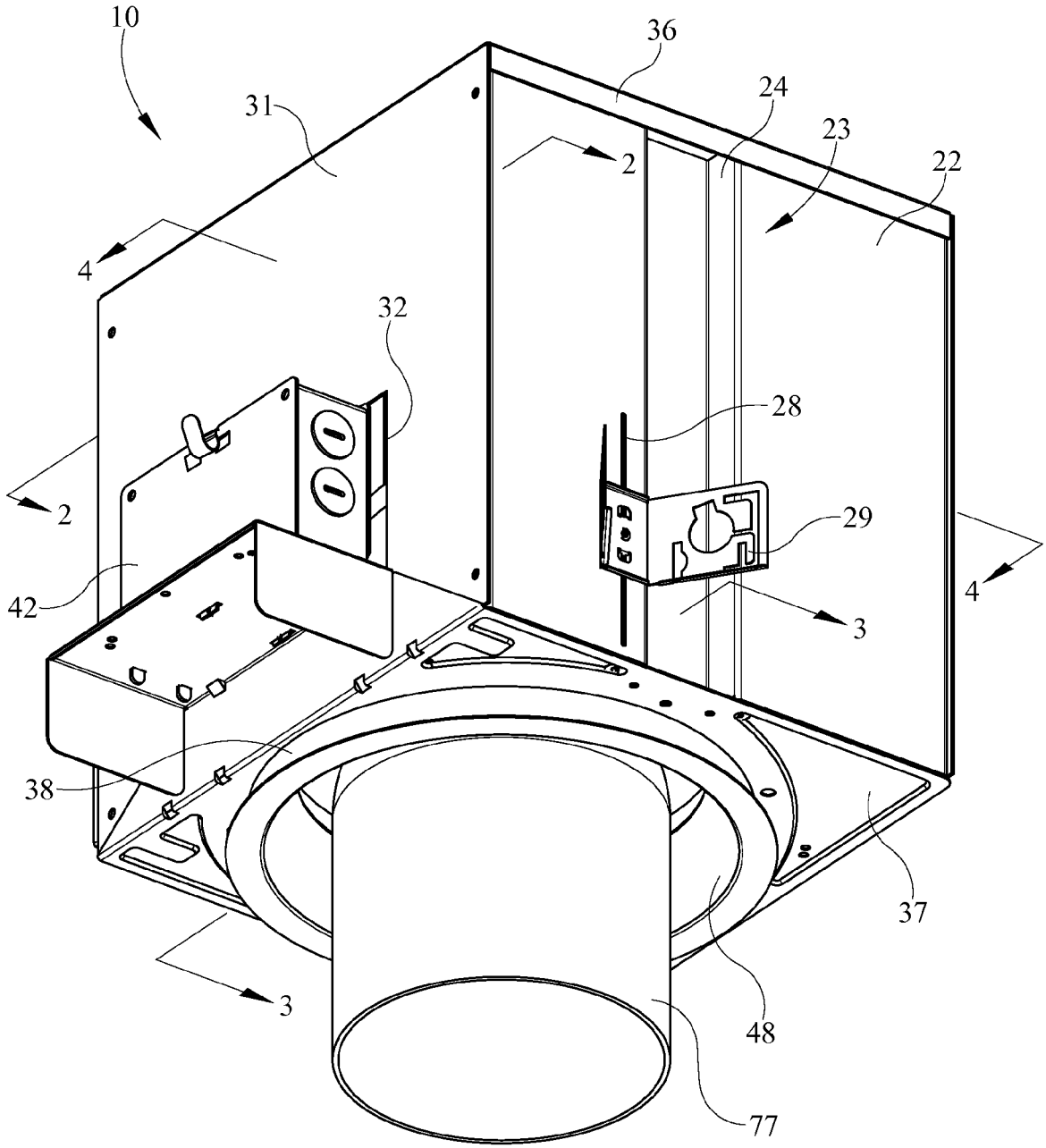
FIG. 1 is a top perspective view of an embodiment of the recessed light fixture.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "leaving" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

The recessed light fixture having integrally formed mounting tracks described herein has a pair of uninterrupted vertically extending mounting tracks integrally formed in opposed sidewalls of the recessed fixture housing. The mounting tracks extend in toward the interior of the housing and have a continuous relatively smooth uninterrupted front face. The recessed light fixture also has a linearly extending lamp support bar that extends between the mounting tracks and has at least one spring clip proximal each end thereof. Each at least one spring clip frictionally engages a corresponding one of the continuous relatively smooth uninterrupted front faces of the mounting tracks, thereby allowing the lamp support bar to be temporarily affixed at a desired vertical orientation along the mounting tracks.

Referring now to FIG. 1 through FIG. 6, wherein like numerals refer to like parts, and initially particularly to FIG. 1 through FIG. 4, an embodiment of a recessed light fixture having integrally formed mounting tracks 10 is shown.

Recessed light fixture 10 has a housing that includes two opposed housing sidewalls with integral tracks 22, and two opposed sidewalls 31 and 34. The housing also includes a housing top 36 and a housing bottom or pan 37. Sidewall 31 has a junction box aperture 32 therethrough to provide access to junction box 42 via an interior door of junction box 42. Housing sidewall 34 is opposite housing sidewall 31 and does not have any apertures or openings in the depicted embodiment. In alternative embodiments housing sidewall 34 may be provided with a junction box or ballast box aperture and a corresponding ballast or junction box.

Housing sidewalls 22, 31, 34, housing top 36, and housing pan 37 define and surround a housing interior. Housing pan 37 is secured to the base of housing sidewalls 22, 31, and 34 and extends between housing sidewalls 22, 31, and 34. Housing pan 37 may be secured to housing sidewalls 22, 31, and 34 using brackets, rivets, and/or fasteners in some embodiments. Housing pan 37 has an annular housing pan flange 38 that extends downwardly and away from housing interior and helps to define an annular pan opening. The pan opening may provide a passageway for light from a light source positioned in the housing interior, allowing light from the light source to exit the housing and illuminate a desired area on the room side of the recessed light fixture housing. The pan opening 32 may also provide a passageway for a light source to extend partially or completely out of the housing interior allowing the light source to be located exteriorly of the housing and illuminate a desired area on the room side of the recessed light fixture 10.

In alternative embodiments the pan opening may have an alternative non-annular shape such as, for example, a rectangular shape. Also, pan flange 39 may have a non-annular shape in alternative embodiments and may even be omitted in alternative embodiments with the pan opening being defined by a flange free aperture through housing pan 37. Two reflector brackets 46 are attached to housing pan 37 proximal the periphery of the pan opening and are offset from one another approximately one-hundred and eighty degrees. The reflector brackets 46 support a reflector or splay trim 48. The splay trim 48 may provided a clean aesthetically pleasing look when the recessed light fixture 10 is installed and/or may optionally provide some reflective characteristics. In alternative embodiments reflector brackets 46 may support alternative reflectors, splay trims, or other structure such as, for example, splay trims having a square opening.

Figure 2:
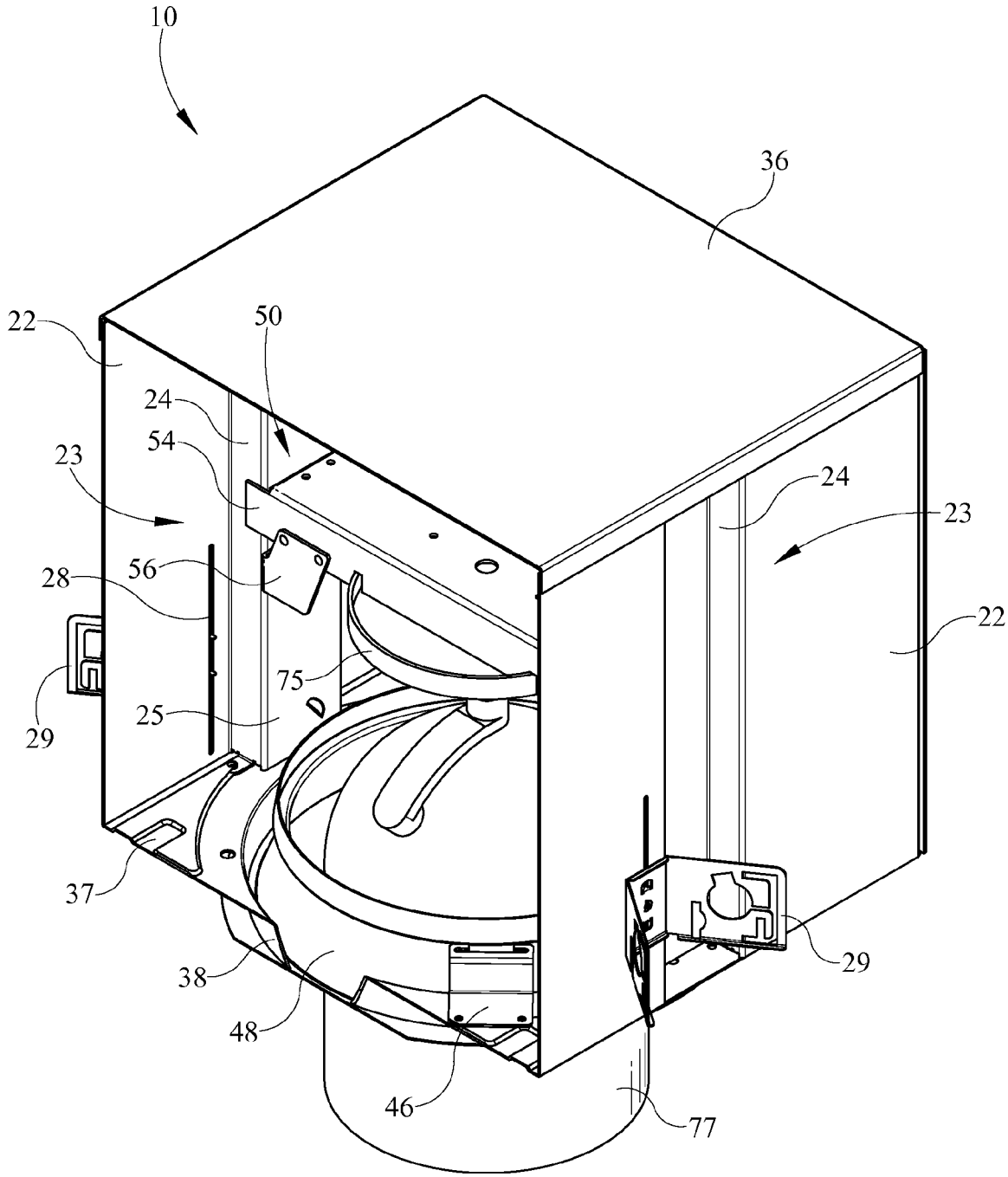
FIG. 2 is a side perspective section view of the recessed light fixture of FIG. 1 taken along the line 2-2 of FIG. 1.
Figure 3:
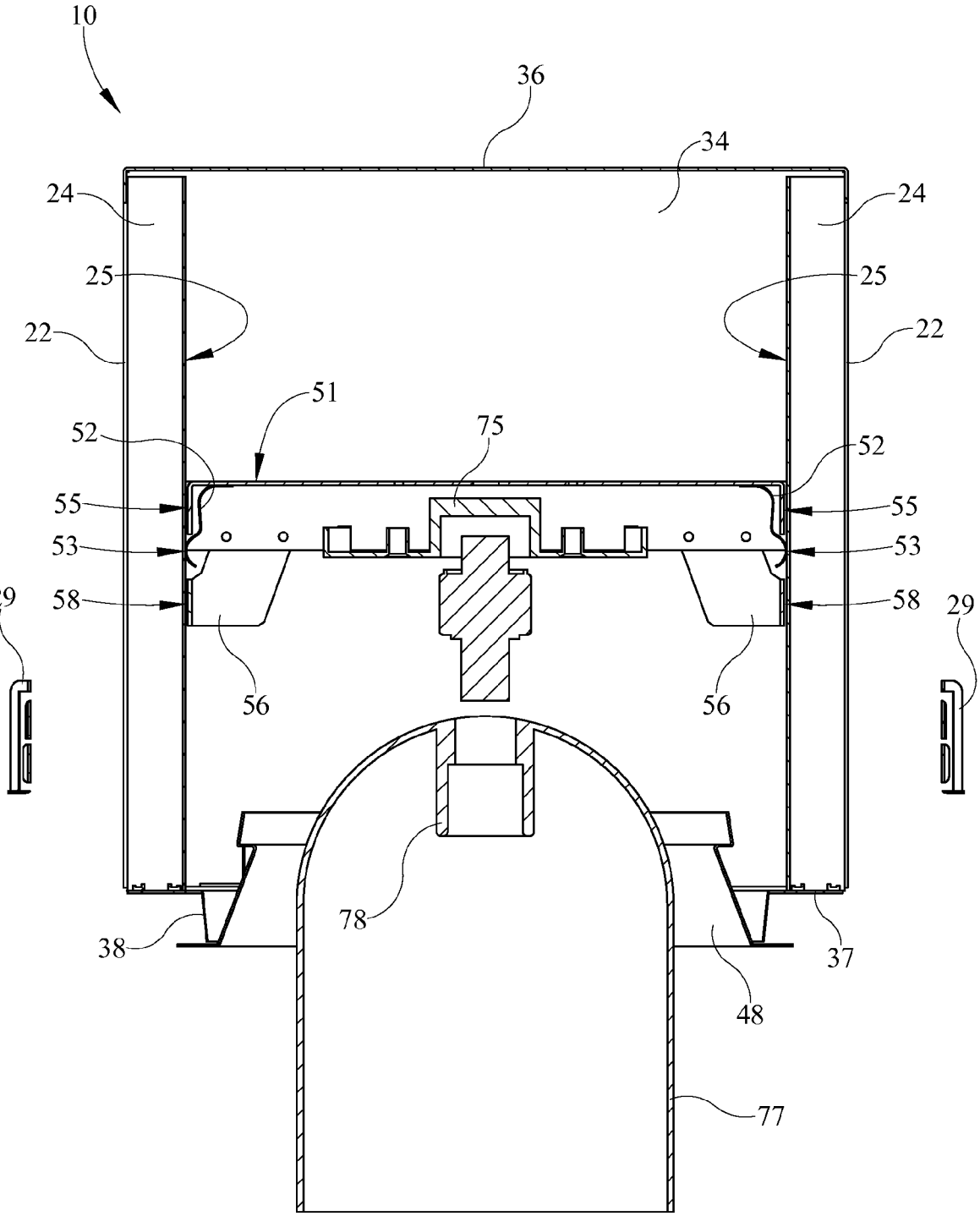
FIG. 3 is a side section view of the recessed light fixture of FIG. 1 taken along the line 3-3 of FIG. 1.
Figure 4:
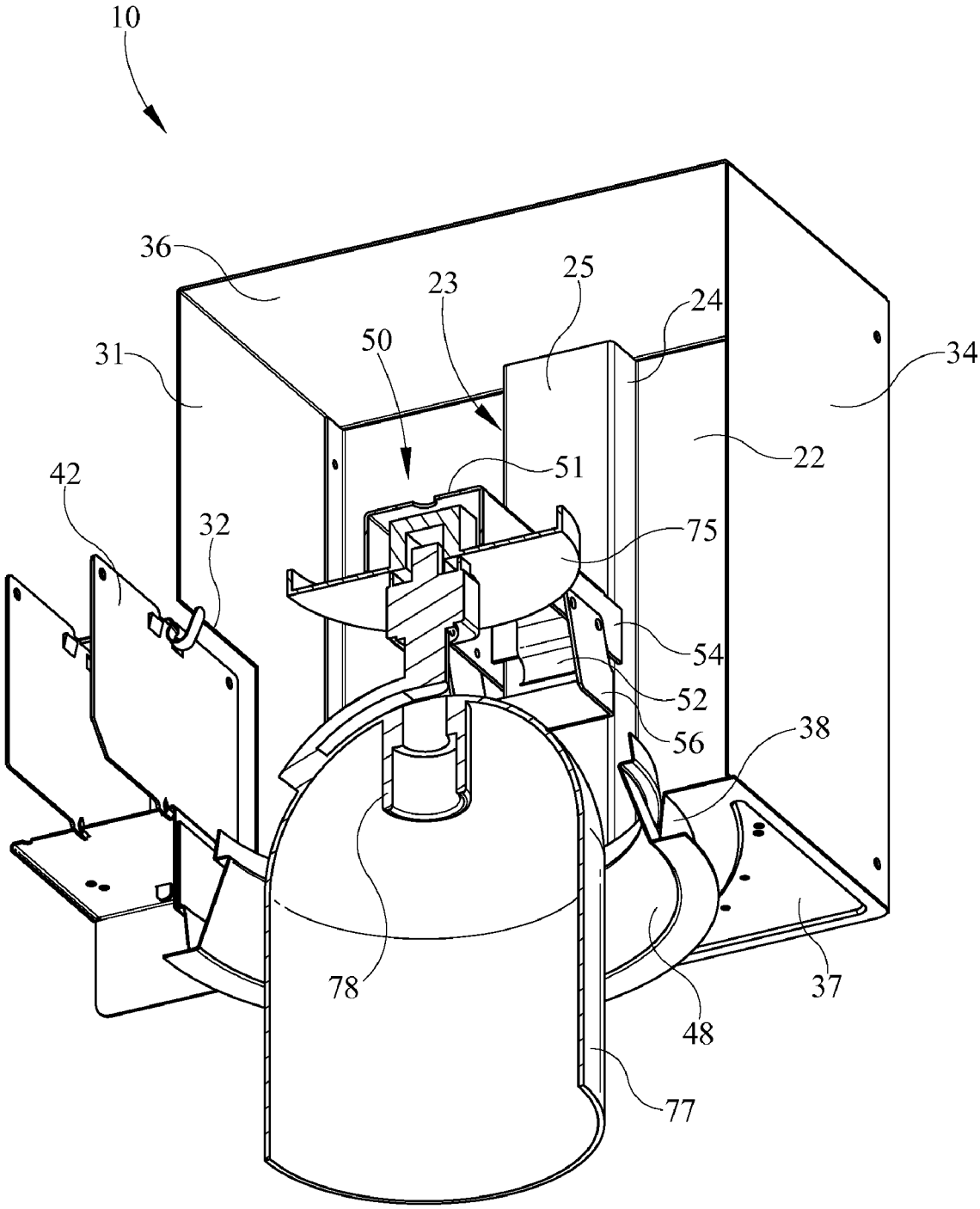
FIG. 4 is a side perspective section view of the recessed light fixture of FIG. 1 taken along the line 4-4 of FIG. 1.

The housing top 36 is shown in FIGS. 2, 3, and 4 atop sidewalls 22, 31, and 34. In some embodiments the housing top 36 may be secured to housing sidewalls 22 by fasteners that may extend through the housing top 36 and mate with corresponding bosses or other structure in sidewalls 22. In alternative embodiments the housing top 36 may be otherwise affixed to or integrally formed with any or all of the housing sidewalls 22, 31, and 24.

A butterfly bracket 29 is attached to the exterior of each housing sidewall 22 and is adjustable vertically within a slot 28 provided through each housing sidewall 22. Each butterfly bracket 29 may receive hanger bars or other structure for appropriately mounting the recessed light fixture 10. A fastener and corresponding wingnut may secure each butterfly bracket 29 to the housing sidewall 21. The wingnut may be loosened and tightened to adjust the location of each butterfly bracket 29 along slots 28 to adjust the vertical positioning of the recessed fixture housing with respect to the ceiling or other structure when installed.

Figure 5:
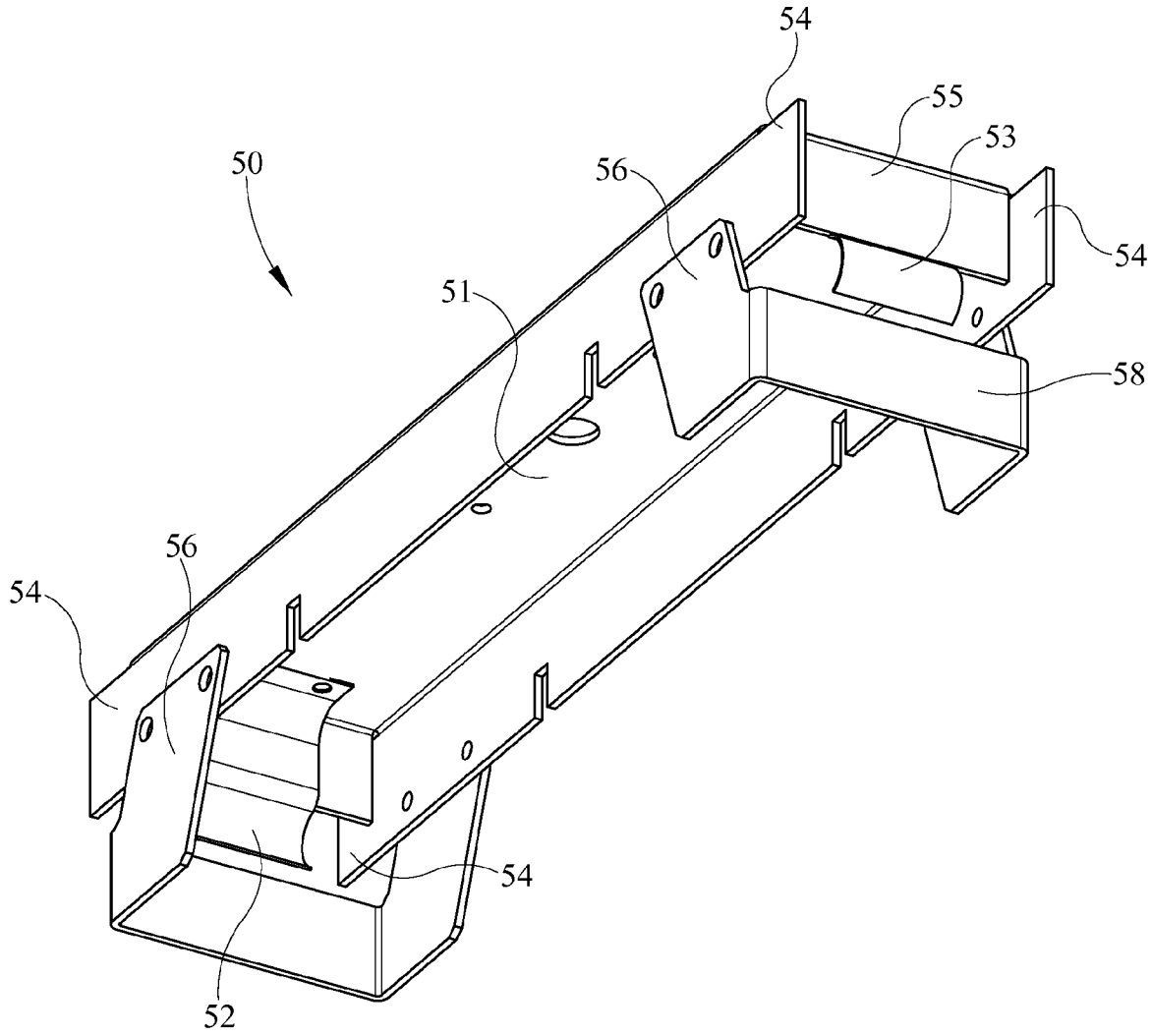
FIG. 5 is a perspective view of an embodiment of a lamp support bar of the recessed light fixture of FIG. 1.
Figure 6:
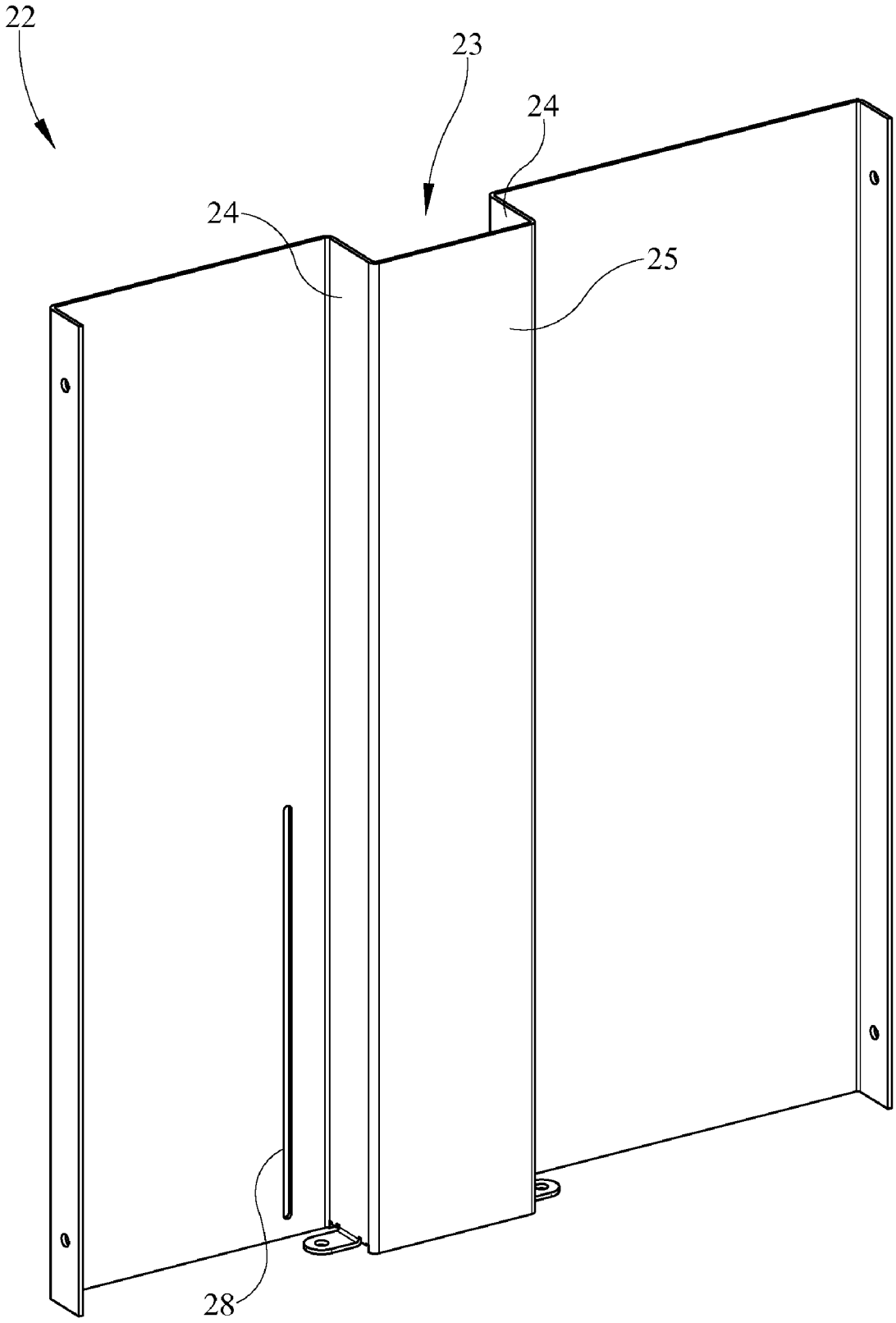
FIG. 6 is a perspective view of an embodiment of a housing panel of the recessed light fixture of FIG. 1 having a sidewall with an integrally formed track therein.

With continuing reference to FIG. 1 through FIG. 4 and additional reference to FIG. 5 and FIG. 6, the mounting tracks 23 integrally formed in housing sidewalls 22 and the lamp height adjustment bracket 50 that extends between the mounting tracks 23 are described in additional detail. Each of the two mounting tracks 23 is vertically extending and integrally formed in a single housing sidewall 22. Each mounting track 23 extends in toward the housing interior and is offset from the remainder of the housing sidewall 22 by track sidewalls 24 that are substantially perpendicular to the housing sidewall 22. A continuous relatively smooth uninterrupted track front face 25 extends between the track sidewalls 24. Each depicted track front face 25 is substantially perpendicular to the track sidewalls 24 and is substantially parallel with the remainder of the housing sidewall 21. Each depicted mounting track 23 extends vertically between distal vertical ends of the housing sidewall 24.

A longitudinally extending lamp support bar or lamp height adjustment bracket 50 extends between the two mounting tracks 23 and is vertically slidably adjustable along the mounting tracks 23 from proximal top 36 to proximal pan 37. Removal of top 36 may allow for removal or insertion of lamp height adjustment bracket 50 from the housing interior. A spring clip 52 is provided proximal each end of the lamp height adjustment bracket 50. In some embodiments each spring clip 52 may be riveted to a base 51 of the lamp height adjustment bracket 50. Each spring clip 52 has a relatively smooth convex contact surface 53 that frictionally engages the track front face 25 of a corresponding mounting track 23. The spring clip 52 is biased such that contact surfaces 53 exert pressure longitudinally outwardly on front faces 25. Surface tension between each spring clip 52 and each front face 25 temporarily affixes the lamp height adjustment bracket 50 at a desired vertical orientation along the mounting tracks 23. A user may adjust the vertical positioning of the lamp height adjustment bracket 50 by applying force, directly or indirectly, to the lamp height adjustment bracket 50 and allowing it to glide along the mounting tracks 23. The lamp height adjustment bracket 50 may be adjusted to any desired vertical position along mounting tracks 23. The spring clip 52 of lamp height adjustment bracket 50 does not need to engage any apertures or protuberances to allow fixation of the height adjustment bracket 50 at one of a plurality of preselected fixed vertical heights.

The lamp height adjustment bracket 50 has a pair of vertically oriented protrusions 54 on each end thereof adjacent the spring clip 52. The protrusions 54 extend longitudinally outward and away from the center of the lamp height adjustment bar 50 and are provided slightly above the convex contact surface 53 of the spring clip 52. When the lamp height adjustment bracket 50 is installed, each pair of the protrusions 54 will flank a corresponding mounting track 23 and each protrusion 54 will be immediately adjacent a track sidewall 24, thereby substantially maintaining the horizontal positioning of lamp height adjustment bracket 50.

Extending between and substantially perpendicular to each pair of the protrusions 54 is a vertically oriented face 55. Each vertically oriented face 55 is adjacent the corresponding contact surface 53 of the spring clip 52 and is provided longitudinally inward from most of the corresponding contact surface 53 when spring clip 52 is in the relaxed uninstalled state, such as shown in FIG. 6. Two anti-racking support brackets 56 are also provided on lamp height adjustment bracket 50. Each of the support brackets 56 has a vertically oriented face 58 that is also adjacent the corresponding convex contact surface 53 of the spring clip 52 and is provided longitudinally inward from most of the corresponding convex contact surface 53 when spring clip 52 is in the relaxed uninstalled state. In the depicted embodiment corresponding face 51 and face 58 are provided in substantially the same plane. Each corresponding face 51 and face 58 are provided latitudinally above and below convex contact surface 53 of a corresponding spring clip 52 and flank convex contact surface 53 of the spring clip 52. When the lamp height adjustment bracket 50 is installed, each face 51 and face 58 will be immediately adjacent a track front face 25 and will prevent racking of lamp height adjustment bracket 50

A light source or lamp may be attached to lamp height adjustment bar 50 to provide for vertical adjustment of the lamp. In the depicted embodiment a track head mount 75 having a track head mount attachment 76 that may be electrically connected to a power source is coupled to a surface of lamp height adjustment bar 50. In some embodiments the track head mount 75 is a mono point track head mount manufactured by Philips Lighting's Capri division and may be electrically connected to a line voltage power source. In the depicted embodiment a track head 77 has a track head mount engagement piece 78 that may removably engage the track head mount attachment 76, thereby coupling the track head 77 to the lamp height adjustment bar 50.

The depicted track head 77 may include a socket 78 that may support a lamp such as, for example, a PAR lamp, and can be rotated three-hundred-and-sixty degrees horizontally and up to sixty degrees vertically to adjustably aim the track head 77. The track head 77 may also be adjusted vertically up and down via adjustment of lamp height positioning bracket 50. In FIGS. 1 through 4 the track head 77 is depicted partially recessed into the housing and partially pulled down out of the housing. The track head 77 may be completely recessed into the housing via upward vertical adjustment of the lamp height positioning bracket 50, thereby enabling the recessed light fixture 10 to perform like a downright. The track head 77 may also be pulled down out of the housing via downward vertical adjustment of the lamp height adjustment bar 50 and rotatably adjusted to perform like an aimable track fixture. Other positionings of track head 77 may be accomplished via vertical adjustment of lamp height positioning bracket 50 and other aiming of track light source 77 may be accomplished via horizontal and/or vertical rotational adjustment of the track head 77.

One of skill in the art will realize that many variations of the recessed light fixture may be made in light of the teachings herein. For example, in alternative embodiments alternative light sources may be used in conjunction with recessed light fixture 10, including low voltage light sources (e.g. AR111, MR16) and ceramic metal halide sources (e.g. T4, T6, BT5, R111). Also, for example, in alternative configurations alternative track heads 77 may be utilized. Also, for example, lamps may be attached to the lamp height adjustment bracket 50 and/or electrically connected to a power source in other manners than those described herein. Also, for example, in alternative embodiments housing top 36 may be alternatively shaped, non-removable and/or integrally formed with one or more of the housing sidewalls 21, 31, 34. Also, for example, in alternative embodiments portions of one or more of the housing sidewalls 21, 31, 34 may be alternatively shaped, integrally formed with the housing top 36 and/or pan 37. Also, for example, in alternative embodiments pan opening may take on alternative shapes, such as for example, a rectangular shape, and may include alternative adjacent mounting structure for supporting finishing trim and/or other items.

The construction elements of the recessed fixture housing 10 may in some embodiments incorporate galvanized steel for the housing and the lamp height adjustment bracket 50. Alternative configurations may incorporate alternative or additional materials for one or more of the constituent parts of the recessed light fixture 10, such as, for example, stainless steel, aluminum, other metals, or plastic.

The foregoing description has been presented for purposes of illustration. It is not intended to be exhaustive or to limit the invention to the precise forms disclosed, and obviously many modifications and variations are possible in light of the above teaching. It is understood that while certain forms of the invention have been illustrated and described, it is not limited thereto except insofar as such limitations are included in the following claims and allowable functional equivalents thereof.

I claim:

1. An adjustable recessed light fixture comprising:

a housing having housing sidewalk, a top, and a pan having a pan opening therethrough; said housing sidewalk, said top, and said pan surrounding and defining a housing interior space;

a pair of vertically extending mounting tracks integrally formed in said housing sidewalk on opposite sides of said housing interior space and extending into said housing interior space, wherein each of said mounting tracks is formed of the same piece of material as its respective housing sidewall;

each of said mounting tracks having a continuous front face interiorly offset from the remainder of a corresponding one of said housing sidewalk;

a linearly extending lamp support bar having at least one spring clip proximal each end thereof;

said lamp support bar extending within said housing between said mounting tracks and being vertically adjustable along said mounting tracks;

wherein each said spring clip of said lamp support bar frictionally engages said continuous front face of a corresponding one of said mounting tracks, thereby allowing said lamp support bar to be temporarily affixed at a desired vertical orientation along said mounting tracks.

2. The adjustable light fixture of claim 1, wherein each said spring clip has an relatively smooth convex contact surface that frictionally engages said front face of a corresponding one of said mounting tracks.

3. The adjustable light fixture of claim 2, wherein said lamp support bar has a pair of vertically oriented protrusions on each end thereof extending longitudinally outward and away from the center of said lamp support bar, wherein each said pair of vertically oriented protrusions flank and are immediately adjacent a corresponding one of said mounting tracks, thereby maintaining said lamp support at a desired horizontal position within said housing.

4. The adjustable light fixture of claim 3, wherein said lamp support bar has a pair of vertically oriented flat faces proximal each end thereof flanking said relatively smooth convex contact surface of said at least one spring clip, and wherein each said pair of vertically oriented flat faces are immediately adjacent a corresponding front face of said mounting tracks.

5. The adjustable light fixture of claim 4, wherein each said front face of said mounting tracks is parallel to the remainder of a corresponding one of said housing sidewalk.

6. The adjustable light fixture of claim 3, further comprising a lamp head coupled to said lamp support bar; said lamp head being hortizontally and vertically rotatable.

7. The adjustable light fixture of claim 6, wherein said lamp head is adjustable via said lamp support bar from a first position being completely within said housing interior space to a second position being completely outside said housing interior space.

8. The adjustable light fixture of claim 1, wherein each end of the lamp support bar is immediately adjacent the continuous front face of its corresponding mounting track.

9. An adjustable recessed light fixture, comprising:

a housing including a pan, a plurality of housing sidewalk, and a top collectively defining a housing interior;

said pan having an opening therethrough;

said plurality of housing sidewalk extending upwardly from said pan to said top; at least one of said housing sidewalk having a junction box aperture provided therethrough;

a pair of vertically extending mounting tracks, each of said mounting tracks integrally formed in a single of two opposed housing sidewalk of said housing sidewalk, wherein each of said mounting tracks is formed of the same piece of material as its respective housing sidewall;

each of said mounting tracks having opposed mounting track sidewalls extending into said housing interior and a front face extending between said mounting track sidewalk;

each said front face being substantially perpendicular to said mounting sidewalk;

a linearly extending lamp support bar having at least one spring clip proximal each end thereof, each said spring clip having a relatively smooth contact surface;

said lamp support bar extending horizontally within said housing between said mounting tracks and being vertically adjustable along said mounting tracks;

wherein said contact surface of each said spring clip frictionally engages said front face of a corresponding one of said mounting tracks, thereby allowing said lamp support bar to be slidably respositioned along said mounting tracks;

wherein said lamp support bar is slidably respositionable along said mounting tracks to any desired nonfixed location.

10. The adjustable light fixture of claim 9, wherein said lamp support bar has a pair of vertically oriented relatively smooth flat faces on each end thereof flanking said relatively smooth contact surface of said at least one spring clip, and wherein each said pair of vertically oriented flat faces are immediately adjacent a corresponding said front face of said mounting tracks.

11. The adjustable light fixture of claim 10, wherein said flat faces on a single end of said lamp support bar are substantially planar with one another.

12. The adjustable light fixture of claim 11, wherein said lamp support bar has a pair of vertically oriented protrusions on each end thereof extending longitudinally outward and away from the center of said lamp support bar, wherein each said pair of vertically oriented protrusions flank and are immediately adjacent a corresponding one of said mounting tracks, thereby maintaining said lamp support at a desired horizontal position within said housing.

13. The adjustable light fixture of claim 12, wherein each said contact surface of each said spring clip is a convex surface.

14. The adjustable light fixture of claim 13, further comprising a lamp head coupled to said lamp support bar; said lamp head being horizontally and vertically rotatable.

15. The adjustable light fixture of claim 14, wherein said lamp head is adjustable via said lamp support bar from a first position being completely within said housing interior to a second position being completely outside said housing interior.

16. An adjustable recessed light fixture comprising:

a housing having a top separated from a pan by housing sidewall structure;

said pan having a pan opening therethrough; said housing sidewall structure, said top, and said pan surrounding and defining a housing interior space;

a pair of vertically extending mounting tracks integrally formed opposite one another in said sidewall structure of said housing and extending into said housing interior space, wherein each of said mounting tracks is formed of the same piece of material as its respective housing sidewall; wherein each of said mounting tracks is formed of the same piece of material as its respective housing sidewall and thereby forms a corresponding channel on the outside of the housing;

each of said mounting tracks extending from immediately adjacent said top to immediately adjacent said pan and having a continuous front face offset interiorly into said housing by a pair of mounting track sidewalls;

a lamp height adjustment bracket having at least one spring clip on each end thereof and a vertically oriented pair of faces flanking each said at least one spring clip;

said lamp height adjustment bracket extending horizontally within said housing between said mounting tracks and being vertically adjustable along said mounting tracks;

wherein each said spring clip is relatively smooth and frictionally engages said front face of a corresponding one of said mounting tracks, thereby allowing said lamp height adjustment bracket to be temporarily affixed at a desired vertical orientation anywhere along said mounting tracks; and wherein each said pair of faces are adjacent and substantially parallel with a corresponding said front face of said mounting tracks.

17. The adjustable light fixture of claim 16, wherein said lamp height adjustment bracket has a pair of vertically oriented protrusions on each end thereof extending longitudinally outward and away from the center of said lamp height adjustment bracket, wherein each said pair of vertically oriented protrusions flank and are immediately adjacent a corresponding one of said mounting tracks, thereby maintaining said lamp support at a desired horizontal position within said housing.

18. The adjustable light fixture of claim 17, wherein said vertically oriented pair of faces on a single end of said lamp height adjustment bracket are planar with one another.

19. The adjustable light fixture of claim 18, wherein each said spring clip includes a relatively smooth uninterrupted convex contact surface that frictionally engages said front face of a corresponding one of said mounting tracks.

20. The adjustable light fixture of claim 19, wherein said mounting track sidewalk are relatively smooth and uninterrupted.

21. The adjustable light fixture of claim 20, further comprising a lamp head coupled to said lamp height adjustment bracket, wherein said lamp head is adjustable via said lamp height adjustment bar from a first position being completely within said housing interior to a second position being completely outside said housing interior.

* * * * *